United States Patent [19]

Berke et al.

[11] Patent Number: 4,710,749

[45] Date of Patent: Dec. 1, 1987

[54] SIREN WITH REMOTE DRIVER

[75] Inventors: Howard M. Berke, Madison; Harold W. Lyons, Deep River, both of Conn.

[73] Assignee: Whelen Engineering Co., Inc., Chester, Conn.

[21] Appl. No.: 946,681

[22] Filed: Dec. 29, 1986

Related U.S. Application Data

[63] Continuation of Ser. No. 648,538, Sep. 10, 1984, abandoned.

[51] Int. Cl.[4] ..... G08B 3/00; G10K 7/00

[52] U.S. Cl. ..... 340/405; 340/387; 340/388

[58] Field of Search ..... 340/405, 387, 388

[56] References Cited

U.S. PATENT DOCUMENTS 2,396,423 3/1946 Hines ..... 340/405

4,241,334 12/1980 Shintaku ..... 340/388

*Primary Examiner*—John W. Caldwell, Sr.

*Assistant Examiner*—Tyrone Queen

*Attorney, Agent, or Firm*—Chilton, Alix & Van Kirk

[57] ABSTRACT

An electronic siren includes a driver unit and a speaker unit which are interconnected by a flexible sound pipe. The sound pipe is acoustically coupled to the driver unit and speaker unit by adaptors which provide a substantially smooth transistion from a driver unit to sound pipe and from sound pipe to speaker whereby attenuation is minimized.

10 Claims, 4 Drawing Figures

SIREN WITH REMOTE DRIVER

This is a continuation of co-pending application Ser. No. 648,538 filed on Sept. 10, 1984, now abandonded.

BACKGROUND OF THE INVENTION (1) Field of the Invention

The present invention relates to the generation of sound and particularly to the projection of a modulated column of air which may function as an audible warning. More specifically, this invention is directed to a siren system and especially to a siren system which may be installed in vehicles where space is severely limited. Accordingly, the general objects of the present invention are to provide novel and improved methods and apparatus of such character.

(2) Description of the Prior Art

While not limited thereto in its utility, the present invention is particularly well-suited for use in siren systems designed for mounting in emergency vehicles. In the interest of fuel economy, many public safety organizations have adopted the use of vehicles generally described as "compact" or "sub-compact" by their manufacturers. While the employment of an audible attention attracting device, i.e., a siren, on such emergency vehicles is mandated, the desire to reduce wind resistance and enhance safety by removing externally mounted irregularly shaped objects dictates that the siren be positioned under the vehicle hood such that the sound produced thereby will be transmitted through the cooling air intake space. As is well known, mounting space is limited in the engine compartment of most modern vehicles and such space is severely limited in compact and sub-compact vehicles. It is equally well known that previously available siren systems were rather bulky devices, i.e., were characterized by volumetric inefficiency. This volumetric inefficiency has previously precluded the under-the-hood mounting of sirens on compact and sub-compact vehicles.

The volumetric efficiency of a siren for use on an emergency vehicle may be enhanced through the use of an "electronic" siren. A electronic siren includes a speaker/driver unit which comprises a compression driver, i.e., a loud speaker capable of high output power which typically employs a phenolic diaphragm. The diaphragm is driven, in the known manner, by the modulated output signal of a power amplifier which may be positioned remotely with respect to the driver unit. A re-entrant horn is mounted on the driver unit whereby, in the manner known in the art, the sound produced by the moving diaphragm will be amplified and directed. The re-entrant horn is typically defined by a speaker bell which has, centrally mounted therein, a speaker cone. The air which is set into motion by the driver unit diaphragm is forced through a throat, i.e., a reduced diameter output portion of the driver unit, and discharges into the cone. The re-entrant horn and bell cooperate to define a relatively long path length along which the cross-sectional area smoothly increases whereby an amplified sound will be projected in a direction which is generally co-axial with the throat of the drive unit. The combination of the driver sub-assembly and re-entrant horn mounted thereon is relatively large.

SUMMARY OF THE INVENTION

The present invention overcomes the above-briefly discussed disadvantage of the prior art and, in so doing, provides a siren system characterized by maximized volumetric efficiency, ease of installation and a high degree of reliability. In achieving these advantages over the prior art the present invention provides for the location of the horn, i.e., the component from which the sound energy is radiated into the environment, at a position which is located remotely with respect to the driver unit, i.e., the component which generates the sound. The horn and driver unit are interconnected by means of a sound pipe, i.e., a conduit which transmits the modulated column of air from the driver unit to the horn with minimal losses and distortion.

Apparatus in accordance with a preferred embodiment of the invention includes a driver unit, a flexible sound pipe as briefly described above, a re-entrant horn or equivalent "speaker" and adapters for mating the driver unit and horn to the sound pipe. The adapters match, without introducing any power attenuating surface irregularities into the path of the sound energy, the driver unit throat to the inner diameter of the sound pipe and match the inner diameter of the sound pipe to the entrance to the cone of the horn. The sound pipe has a length which is a function of the range of output frequencies of the driver unit, this length being in multiples of four inches. The total length of the sound pipe is at least thirty-six inches.

BRIEF DESCRIPTION OF THE DRAWING

The present invention may be better understood and its numerous objects and advantages will become apparent to those skilled in the art by reference to the accompanying drawing wherein like reference numerals refer to like elements in the several FIGURES and in which.

DESCRIPTION OF THE DISCLOSED EMBODIMENT

Figure 1:
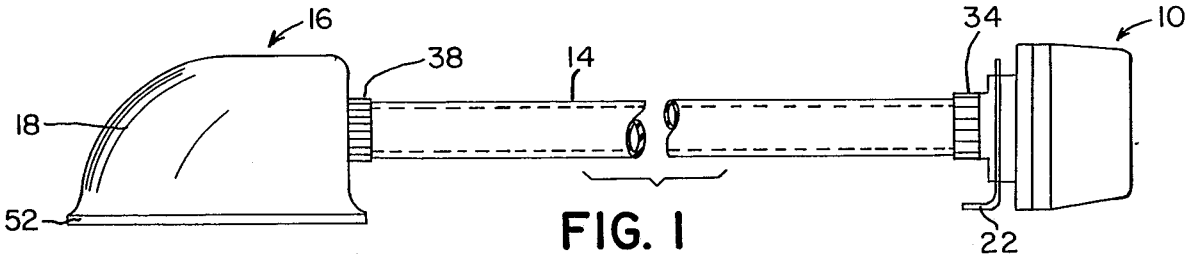
FIG. 1 is a side elevation view of a siren in accordance with a preferred embodiment of the present invention.

With reference to the drawing, a siren driver unit is indicated generally at 10. Driver 10 may, for example, be a commercially available 100 watt compression-type driver such as model SD-370 available from Atlas Sound of Parsippany, N.J. Driver 10 will be energized by the output of an amplifier, not shown, which receives as its input the alternating signal provided by a controllable oscillator. In accordance with the preferred embodiment of the present invention, the energization signal provided to the voice coil of driver 10 will be in the frequency range of 500–1500 Hz. The air which is set into motion by movement of the diaphragm in driver 10 will be caused to move along a path which is convergent from the diaphragm to a throat which is defined by an axial passage in an externally threaded coupling 12 which forms a part of the casing of driver 10. The output of driver 10, i.e., a series of pulses which define a moving column of air modulated by a driver energization signal in the audible frequency range, will be coupled to a sound pipe 14 in the manner to be described below. The end of sound pipe 14 disposed away from driver 10 will, also in the manner to be described below, be coupled to a unique reentrant horn or "speaker" which has been indicated generally at 16. Speaker 16 will include an external speaker bell 18 and, centrally mounted therein, a speaker cone 20. Bell 18 and cone 20 cooperate to define the re-entrant horn.

The sound pipe 14 comprises, in one reduction to practice, a wire wrapped butal rubber hose having a smooth bore. It is essential that sound pipe 14 be capable of flexing without kinking so that, when the siren system is installed, there will be no surface irregularities in the sound path between driver 10 and speaker 16. In the example being described, wherein driver 10 was energized by a signal which is variable in the frequency range of 500–1500 Hz, the length of sound pipe 14 is in multiples of four inches and, preferably, sound pipe 14 will be at least thirty-six inches in length. Sound pipe 14 will be marked at four inch intervals on its exterior so that it may be cut to the proper length during installation of the system.

A siren system in accordance with the present invention further includes a mounting bracket 22 for driver 10. Bracket 22 is connected to the housing of driver 10 by means of mounting bolts 26. Bolts 26 extend through apertures provided in bracket 22 and engage tapped bosses which are integral with the driver housing. Lock washers 28 prevent unintentional loosening of bolts 26 resulting from vibration.

Figures 3, 4:
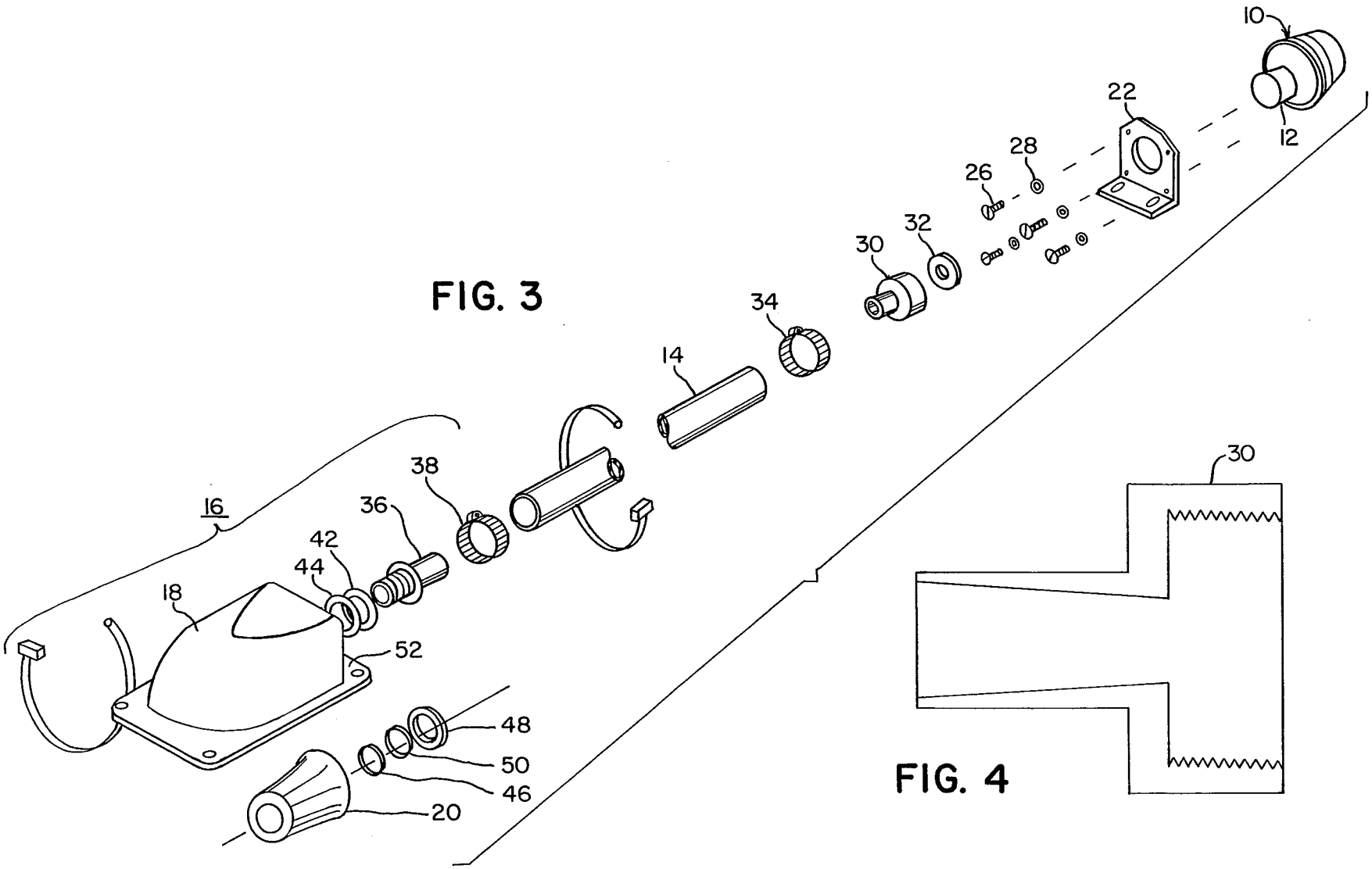
FIG. 3 is an exploded view of the siren of FIGS. 1 and 2.
FIG. 4 is a cross-sectional side elevation view, on an enlarged scale, of the driver unit-to-sound pipe adapter of the siren of FIGS. 1–3.

The externally threaded coupling 12 of driver 10 extends through an aperture in bracket 22 and is engaged by a driver adapter 30. As may be seen by reference to FIG. 4, which is a cross-sectional view of adapter 30 shown on an enlarged scale, the adapter defines a smoothly divergent passage extending between the throat of driver 10 and the internal diameter of sound pipe 14. There is, of necessity, a small lip at the downstream end of adapter 30. A washer 32 is received in adapter 30 and provides an air-tight seal between the internally threaded adapter and the threaded coupling 12 of the driver 10.

The downstream end of adapter 30, i.e., the portion of the adapter which is disposed away from coupling 12 of driver 10, has a reduced external diameter when compared to the internally threaded portion of the adapter which mates with coupling 12. This reduced diameter portion of adapter 30 is inserted in sound pipe 14 and the adapter and sound pipe are held together by means of a hose clamp 34. The four inch marking on sound pipe 14 takes into account the spacing between the entrance end of the sound pipe and the throat of driver 10.

The sound pipe 14 is clamped, at its other end, to a speaker adapter 36 by means of a hose clamp 38. Adapter 36 defines a passage which, to the extent possible, smoothly matches the internal diameter of sound pipe 14 to the entrance end of speaker cone 20. Adapter 36 5, is also designed so as not to obstruct the divergent path for the sound defined by the combination of the cone and bell. The speaker cone 20 is of conventional construction. The speaker cone 20 has an internally threaded coupling member and the downstream end of adapter 36 is externally threaded to mate with the coupling member. A spacer 42 and seal ring 44 are positioned between a flange provided on the exterior of adapter 36 and the shoulder defined by the upstream end of coupling 40 of speaker cone 20. The speaker bell 18 is clamped in position between adapter 36 and speaker cone 20 and a pair of further seals 46 and 48 and a further spacer 50 are provided between cone 20 and the interior mounting surface of bell 18.

Figure 2:
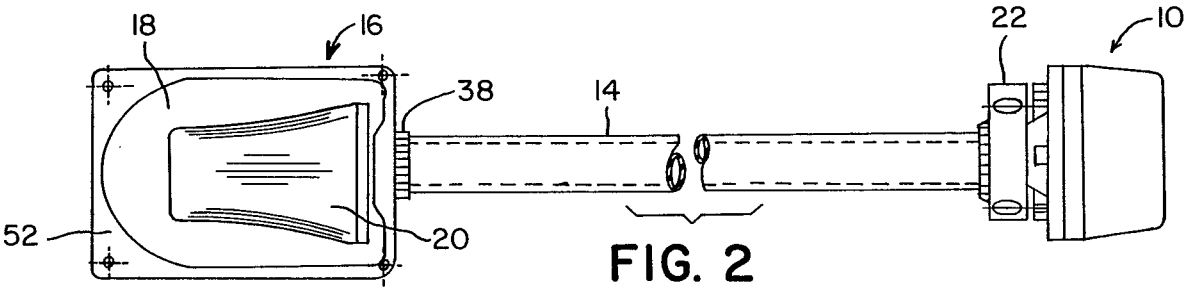
FIG. 2 is a view similar to FIG. 1 with the disclosed embodiment being rotated by 90°.

Bell 18 is designed for side mounting, i.e., the axis of adapter 36 is transverse to the direction in which sound energy will be radiated from the speaker subassembly 16. The sound which exits cone 20 will, accordingly, be turned by inner contour of bell 18, which may best be seen from joint consideration of FIGS. 1 and 2, so as to be projected in a direction which is generally transverse to the plane of the mounting flange 52 of bell 18.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A siren comprising:

a sound wave generator, said sound wave generator being responsive to an alternating electrical signal and including a movable diaphragm, said sound wave generator further including a passage which converges to a throat, said passage having an exit end through which sound produced by movement of said diaphragm exits said generator;

speaker means including a horn from which sonic energy delivered to said speaker means is radiated, said horn defining a radiation pattern;

a sound pipe capable of flexing in any direction without kinking, said sound pipe having a substantially uniform inner diameter with a smooth inner surface, and first and second oppositely disposed ends; and first and second adapter means for acoustically coupling the first and second ends of said sound pipe respectively to said generator and speaker means.

2. The apparatus of claim 1 wherein the inner diameter of said sound pipe at said first end thereof is greater than the diameter of said throat and wherein a first of said adapter means defines a divergent smooth walled conduit which extends between the exit end of said passage and said first end of said sound pipe.

3. The apparatus of claim 2 wherein said sound pipe is at least 36 inches in length, the second said adapter means defines a smooth walled conduit between the second end of the sound pipe and the speaker means, and the total length of said sound pipe and the conduits defined by said adapted means is a multiple of 4 inches.

4. The apparatus of claim 1 wherein said speaker means includes:

cone means having an axis, said cone means defining a folded sound transmission path which increases in cross-sectional area in the direction of travel of sonic energy delivered thereto, the second of said adapter means being connected to said cone means, said cone means defining an annular discharge port on said axis through which the generated sound is delivered into said horn; and said horn redirecting sound delivered thereto from said cone means, said horn being provided with a mounting flange which surrounds the end thereof from which the sound is radiated.

5. The apparatus of claim 4 wherein said horn redirects the sound in a direction which is generally transverse to the axis of the discharge port of said cone means.

6. The apparatus of claim 5 wherein the inner diameter of said sound pipe at said first end thereof is greater than the diameter of said throat and wherein a first of said adapted means defines a divergent smooth walled conduit which extends between the exit end of said passage and said first end of said sound pipe.

7. The apparatus of claim 6 wherein said horn redirects the sound in a direction which is generally transverse to the axis of the discharge port of said cone means.

8. The apparatus of claim 7 wherein said sound pipe is at least 36 inches in length, the second of said adapter means defines a smooth walled conduit between the second end of the sound pipe and the speaker means and the total length of said sound pipe and the conduits defined by said adapter means is a multiple of 4 inches.

9. The apparatus of claim 1 wherein said sound pipe is a wire wrapped rubber hose.

10. The apparatus of claim 7 wherein said sound pipe is a wire wrapped rubber hose.

* * * * *